US009004115B2

(12) United States Patent
Krause et al.

(10) Patent No.: US 9,004,115 B2
(45) Date of Patent: Apr. 14, 2015

(54) METHOD AND SYSTEM FOR DISPENSING ICE AND/OR A LIQUID

(75) Inventors: Andrew Reinhard Krause, La Grange, KY (US); Lorina June White, Louisville, KY (US)

(73) Assignee: General Electric Company, Schenectady, NY (US)

( * ) Notice: Subject to any disclaimer, the term of this patent is extended or adjusted under 35 U.S.C. 154(b) by 749 days.

(21) Appl. No.: 13/174,006

(22) Filed: Jun. 30, 2011

(65) Prior Publication Data

US 2013/0000337 A1 Jan. 3, 2013

(51) Int. Cl.

| | |
|---|---|
| ***B65B 3/04*** | (2006.01) |
| ***F25D 23/12*** | (2006.01) |
| ***B67D 1/08*** | (2006.01) |
| ***B67D 1/12*** | (2006.01) |

(52) U.S. Cl.

CPC ..... *F25D 23/126* (2013.01); *B67D 1/0888* (2013.01); *B67D 1/1236* (2013.01); *B67D 1/124* (2013.01); *F25C 2400/10* (2013.01); *F25C 2700/02* (2013.01); *F25C 2700/04* (2013.01); *F25D 2700/06* (2013.01)

(58) Field of Classification Search

USPC ..... 141/94–95, 192, 351, 1, 2, 9

See application file for complete search history.

(56) References Cited

U.S. PATENT DOCUMENTS

| | | | | |
|---|---|---|---|---|
| 5,491,333 | A * | 2/1996 | Skell et al. | 250/222.1 |
| 6,681,585 | B1 | 1/2004 | Stagg et al. | |
| 6,705,356 | B2 | 3/2004 | Barton et al. | |
| 6,988,405 | B2 | 1/2006 | Jakoby et al. | |
| 7,109,512 | B2 | 9/2006 | Wirthlin | |
| 7,661,448 | B2 | 2/2010 | Kim et al. | |
| 7,673,661 | B2 | 3/2010 | Chase et al. | |
| 7,743,801 | B2 | 6/2010 | Janardhanam et al. | |
| 7,866,165 | B2 | 1/2011 | Jang et al. | |
| 8,109,301 | B1 * | 2/2012 | Denise | 141/360 |
| 8,245,735 | B2 * | 8/2012 | Chase et al. | 141/1 |
| 8,695,646 | B2 * | 4/2014 | Agam et al. | 141/95 |
| 2008/0156395 | A1 | 7/2008 | Janardhanam | |
| 2009/0071567 | A1 * | 3/2009 | Cooper | 141/94 |
| 2009/0183796 | A1 | 7/2009 | Chase et al. | |
| 2010/0155415 | A1 | 6/2010 | Ashrafzadeh et al. | |
| 2010/0224279 | A1 * | 9/2010 | Chou | 141/1 |
| 2013/0228250 | A1 * | 9/2013 | Agam et al. | 141/83 |

* cited by examiner

*Primary Examiner* — Timothy L Maust
*Assistant Examiner* — Timothy P Kelly
(74) *Attorney, Agent, or Firm* — GE Global Patent Operation; Marc A. Vivenzio

(57) ABSTRACT

A dispensing system includes a detection device and a dispenser configured to dispense at least one of ice and a liquid. The detection device is configured to detect a container positioned with respect to the dispenser and generate a first signal representative of the container position. The dispensing system also includes a controller coupled to the detection device and the dispenser. The controller is configured to determine a stability of the container and activate the dispenser to dispense at least one of an amount of the ice and an amount of the liquid into the container based on the first signal and the determined stability of the container.

18 Claims, 5 Drawing Sheets

METHOD AND SYSTEM FOR DISPENSING ICE AND/OR A LIQUID

BACKGROUND OF THE INVENTION

1. Field of the Invention

The field of the invention relates generally to dispensing systems and, more particularly, to a method and system for dispensing ice and/or a liquid.

2. Description of Related Art

At least some conventional appliances, such as refrigerators, include a dispensing system having a storage tank for cooling and storing water, an ice maker, and a dispenser to dispense ice and/or water. The dispensing system dispenses ice and/or water upon actuating a lever located within a door of the refrigerator. The user physically touches or contacts the lever to exert a sufficient force to move the lever and actuate the dispensing system. However, users may have difficulty actuating the lever.

Ice and/or water is continuously dispensed as long as the lever is actuated. If users do not timely deactivate the lever, ice and/or water may undesirably spill from a container positioned with respect to the dispenser. Further, repeated contact with the lever may promote unsanitary conditions. Additionally, a user generally must hold the container in position against the lever to continue dispensing the ice and/or water. As such, the user may be unable to engage in other activities while the container is filled.

BRIEF SUMMARY OF THE INVENTION

In one embodiment, a dispensing system includes a detection device and a dispenser configured to dispense at least one of ice and a liquid. The detection device is configured to detect a container positioned with respect to the dispenser and generate a first signal representative of the container position. The dispensing system also includes a controller coupled to the detection device and the dispenser. The controller is configured to determine a stability of the container and activate the dispenser to dispense at least one of an amount of the ice and an amount of the liquid into the container based on the first signal and the determined stability of the container.

In another embodiment, a refrigeration appliance having a recess includes a dispenser and a detection device. The detection device is positioned with respect to the recess and configured to detect a container positioned within the recess and generate a first signal representative of a position of the container within the recess. The refrigeration appliance also includes a controller coupled to the detection device and the dispenser. The controller is configured to determine a stability of the container and activate the dispenser to dispense at least one of an amount of ice and an amount of liquid into the container based on the first signal and the determined stability of the container.

In yet another embodiment, a method for dispensing at least one of ice and a liquid into a container includes detecting a container positioned within a recess defined within a housing and determining a stability of the container. In response to the detected container and the determined stability of the container within the recess, a dispenser of a dispensing system is activated to dispense at least one of an amount of the ice and an amount of the liquid into the container.

BRIEF DESCRIPTION OF THE DRAWINGS

FIG. 1 is a perspective view of an exemplary refrigerator.

FIG. 2 is a front view of the refrigerator shown in FIG. 1 with a dispensing system.

FIG. 3 is a block diagram of an exemplary dispensing system mounted within a recess defined by the refrigerator shown in FIG. 1.

FIG. 4 is a block diagram of an exemplary sensor module suitable for use with the dispensing system shown in FIG. 3.

FIG. 5 is a block diagram of the dispensing system shown in FIG. 3.

FIG. 6 is a flow diagram of an exemplary method for dispensing a liquid and/or ice that may be used with the dispensing system shown in FIG. 3.

FIG. 7 is a block diagram of another exemplary dispensing system that may be used with the refrigerator shown in FIG. 1.

DETAILED DESCRIPTION OF THE INVENTION

Figure 1:
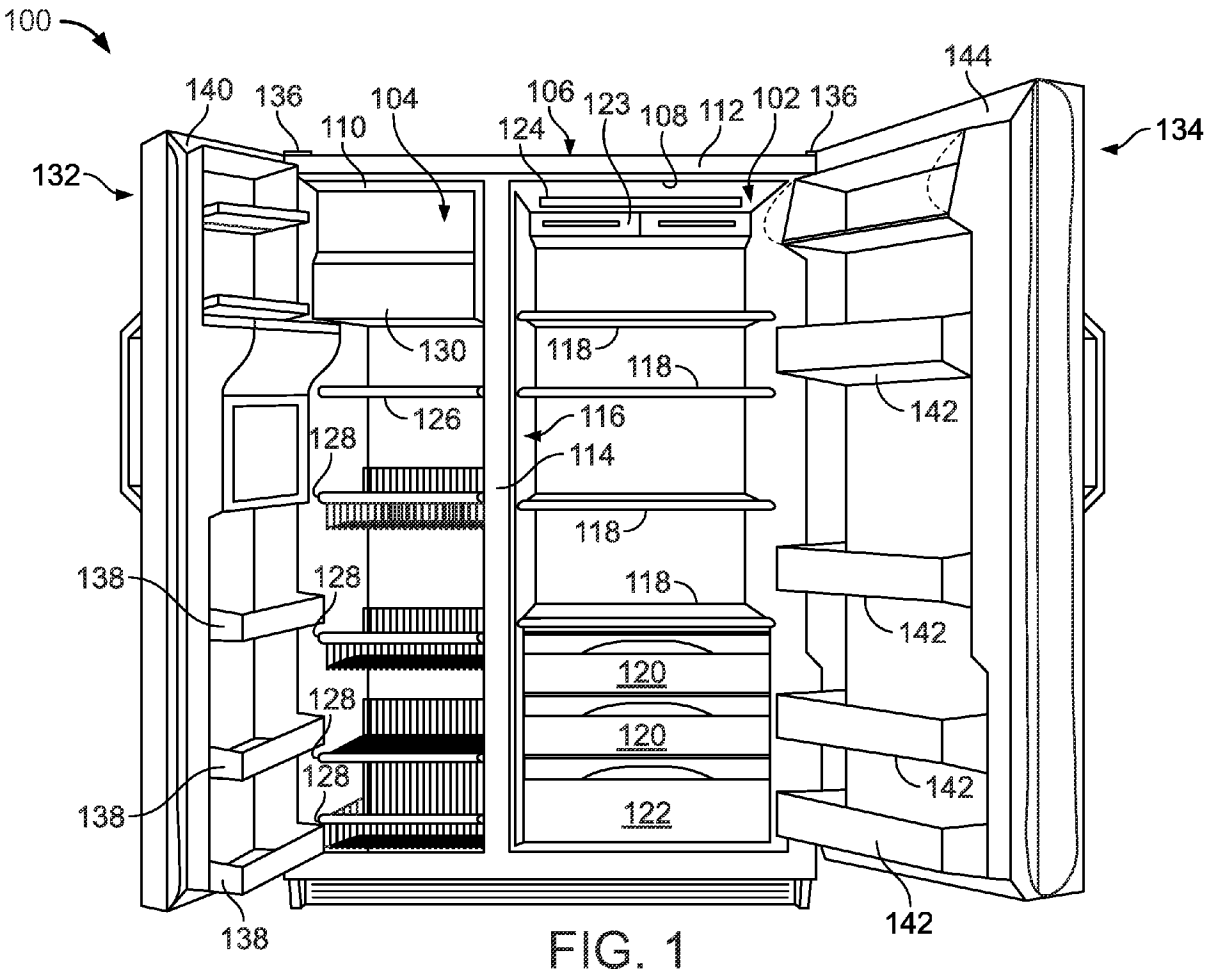
FIGS. 1-7 show exempla embodiments of the systems and method described herein.

FIG. 1 is a perspective view of an exemplary refrigeration appliance, or refrigerator 100, in which exemplary embodiments of the present invention may be practiced and for which one or more benefits of the invention may be realized. Refrigerator 100 includes a fresh food storage compartment 102 and a freezer storage compartment 104. The refrigerator 100 as described and shown herein is for illustrative purposes only and is not intended to limit the herein described methods and systems.

Fresh food storage compartment 102 and freezer storage compartment 104 are arranged side-by-side and are contained within an outer case 106 and inner liners 108 and 110. A space between outer case 106 and inner liners 108 and 110, and between inner liners 108 and 110, is filled with foamed-in-place insulation. Outer case 106 is formed by folding a sheet of a suitable material, such as pre-painted steel, into an inverted U-shape to form top and side walls of outer case 106. A bottom wall of outer case 106 is formed separately and attached to the case side walls and to a bottom frame that provides support for refrigerator 100. Inner liners 108 and 110 are molded from a suitable plastic material to form fresh food storage compartment 102 and freezer storage compartment 104, respectively. Alternatively, inner liners 108 and 110 may be formed by bending and welding a sheet of a suitable metal, such as steel. The illustrative embodiment includes two separate inner liners 108 and 110 as it is a relatively large capacity unit and separate liners add strength and are easier to maintain within manufacturing tolerances. In smaller refrigerators, a single liner is formed and a mullion spans between opposite sides of the liner to divide it into a freezer storage compartment and a fresh food storage compartment.

A breaker strip 112 extends between a case front flange and outer front edges of inner liners 108 and 110. Breaker strip 112 is formed from a suitable resilient material, such as an extruded acrylo-butadiene-styrene based material (commonly referred to as ABS).

The insulation in the space between inner liners 108 and 110 is covered by another strip of suitable resilient material, which commonly is referred to as a mullion 114. Mullion 114 also preferably is formed of an extruded ABS material. Breaker strip 112 and mullion 114 form a front face, and extend completely around inner peripheral edges of outer case 106 and vertically between inner liners 108 and 110. Mullion 114, insulation between compartments, and a spaced wall of liners separating compartments are collectively referred to herein as a center mullion wall 116.

Shelves 118 and slide-out drawers 120 are provided in fresh food storage compartment 102 to support items being stored therein. A storage assembly 122 is provided in a lower portion of fresh food storage compartment 102, and is selectively controlled, together with other refrigerator features, by a controller 123 according to user preference via manipulation of a control interface 124 mounted in an upper region of fresh food storage compartment 102 and coupled to controller 123. In addition, at least one shelf 126 and at least one wire basket 128 are also provided in freezer storage compartment 104. In alternative embodiments, a position of storage assembly 122, controller 123, and/or control interface 124 is varied in alternative embodiments.

Controller 123 is mounted within refrigerator 100, and is programmed to perform functions described herein. As used herein, the term controller is not limited to just those integrated, circuits referred to in the art as microprocessors, but broadly refers to computers, processors, microcontrollers, microcomputers, programmable logic controllers, application specific integrated circuits, and other programmable circuits, and these terms are used interchangeably herein.

Figure 2:
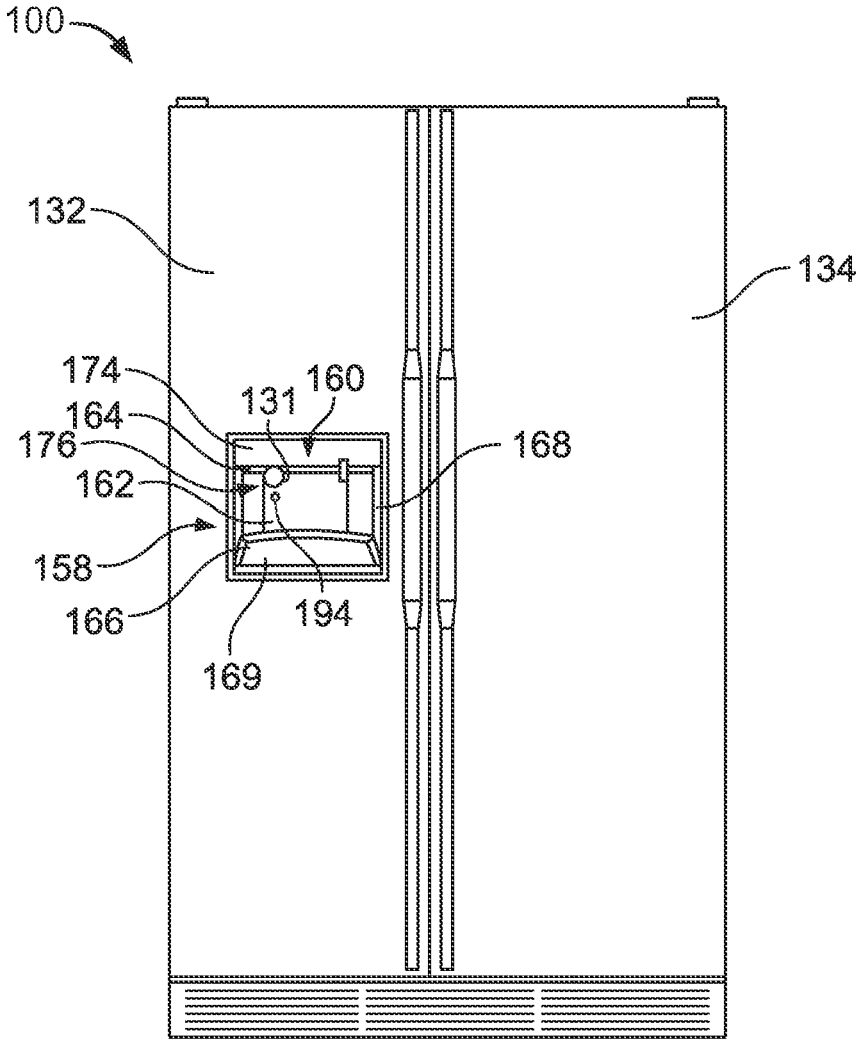

In the exemplary embodiment, freezer storage compartment 104 includes an automatic ice maker 130 and a dispenser 131, shown in FIG. 2, positioned in freezer door 132 such that ice and/or chilled water can be dispensed without opening freezer door 132. Ice maker 130 includes a number of electromechanical elements that manipulate a mold to shape ice as water freezes, a mechanism to remove or release ice from the mold, and a primary ice bucket for storage of ice produced in the mold. Periodically, the ice supply is replenished by ice maker 130 as ice is removed from the primary ice bucket.

Freezer door 132 and a fresh food door 134 close access openings to freezer storage compartment 104 and fresh food storage compartment 102. Each door 132 and 134 is mounted by a top hinge 136 and a bottom hinge (not shown) to rotate about an outer vertical edge of each door 132 and 134 between an open position, as shown in FIG. 1, and a closed, position, as shown in FIG. 2, sealingly closing the associated storage compartment. Freezer door 132 includes a plurality of storage shelves 138 and a sealing gasket 140. Fresh food door 134 also includes a plurality of storage shelves 142 and a sealing gasket 144.

Refrigerator 100 also includes a machinery compartment (not shown) that at least partially contains components for executing a known vapor compression cycle for cooling air. The components include a compressor, a condenser, an expansion device, and an evaporator (none shown) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator or freezer compartments via fans (not shown). Collectively, the vapor compression cycle components in a refrigeration circuit, associated fans, and associated compartments are referred to herein as a sealed system. The construction of the sealed system is well known and therefore not described in detail herein. The sealed system is operable to force cold air through the refrigerator.

FIG. 2 is a front view of refrigerator 100 with doors 132 and 134 in a closed position. A recess 158 is defined within a front surface of freezer door 132, and a touchless dispensing system 160 is at least partially mounted on and/or within freezer door 132 and within recess 158. As such, freezer door 132 provides a housing for dispensing system 160 and recess 158. As used herein, the term "touchless" refers to a system, such as dispensing system 160, that is enabled to dispense liquid and/or ice into a container without the container contacting components of the dispensing system and/or components of a detection device associated with or included within the dispensing system, as described more fully herein. Alternatively, recess 158 is defined within fresh food door 134 and dispensing system 160 is at least partially mounted on and/or within recess 158 and/or fresh food door 134.

In one embodiment, recess 158 includes a back wall 162, a top wall 164, a bottom wall 166 and two side walls 168 coupled, molded or integrated with each other. Bottom wall 166 defines a support surface 169 for supporting a container, such as, without limitation, a cup, pitcher or bowl (not shown) positioned within recess 158. Dispensing system 160 includes dispenser 131 that extends into recess 158, such as through top wall 164 of recess 158. Dispenser 131 is configured to dispense ice and/or at least one liquid, such as chilled water, as desired. A user interface 174 is mounted on the front face of freezer door 132. Controller 123 (shown in FIG. 1) is coupled in operational control communication and/or signal communication with dispenser 131 and user interface 174. As such, controller 123 operates dispenser 131 according to user selection through user interface 174. It should be apparent to those skilled in the art and guided by the teachings herein provided that dispenser 131 and/or user interface 174 may be mounted at any suitable position with respect to refrigerator 100 in alternative embodiments, such as on fresh food door 134.

A detection device 176 is mounted with respect to recess 158. In one embodiment, detection device 176 is mounted on, or at least partially within, back wall 162 of recess 158. Detection device 176 is configured to detect a container, such as a cup or other suitable container, positioned adjacent to, or within, recess 158 without contact between components of detection device 176 and the container. Upon detection of the container, detection device 176 generates a signal confirming a position of the container, and transmits the generated signal to controller 123. Controller 123 activates dispenser 131 at least partially based on, or in response to, the signal received from detection device 176. It is apparent to those skilled in the art and guided by the teachings herein provided that detection device 176 may be mounted at any suitable position on or with respect to refrigerator 100 in alternative embodiments.

In the exemplary embodiment, a user may activate dispenser 131 to fill a container while fresh food door 134 is open. As user interface 174 and dispensing system 160 are mounted on, or within, freezer door 132, the user may open fresh food door 134 to access objects positioned within fresh food storage compartment 102 while the container is being filled by dispenser 131.

In an alternative embodiment, refrigerator 100 includes two fresh food doors 134 arranged in a side-by-side configuration. Freezer storage compartment 104 and freezer door 132 are positioned below fresh food storage compartment 102 and fresh food doors 134 in a bottom-mounted freezer configuration (not shown). In such an arrangement, dispensing system 160 is mounted on, or mounted within, a first fresh food door 134 such that first fresh food door 134 and dispensing system 160 are electrically and/or mechanically isolated from a second fresh food door 134. A user may access fresh food storage compartment 102 using second fresh food door 134 and/or may access freezer storage compartment 104 using freezer door 132 while dispenser 131 is dispensing ice and/or liquid into a container.

Figure 3:
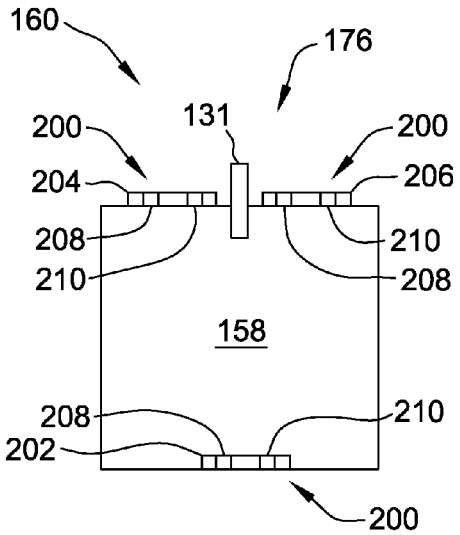

FIG. 3 is a block diagram of dispensing system 160 including detection device 176 mounted and/or positioned with respect to recess 158. In the exemplary embodiment, device 176 includes a plurality of sensor modules 200, such as a first sensor module 202 and a second sensor module 204, coupled in communication with controller 123. In one embodiment, device 176 includes a third sensor module 206 and/or any number of additional sensor modules 200 that enables dispensing system to function as described herein. In the exemplary embodiment, first sensor module 202 and second sensor module 204 are configured to transmit and/or receive acoustic signals. Alternatively, first sensor module 202 and second sensor module 204 are configured to transmit and/or receive radio and/or microwave signals.

In the exemplary embodiment, first sensor module 202 is mounted on, or at least partially within, back wall 162 of recess 158 and/or proximate to bottom wall 166. Second sensor module 204 is mounted on, or at least partially within, top wall 164 of recess 158. In addition, second sensor module 204 is positioned proximate dispenser 131. Alternatively, first sensor module 202 and second sensor module 204 are mounted on, or at least partially within, any suitable location or portion of recess 158 and/or freezer door 132. In the exemplary embodiment, each sensor module 200 includes a transmitter 208 and a receiver 210. Alternatively, one or more sensor modules 200 include at least one transceiver (not shown) in place of transmitter 208 and/or receiver 210.

In one embodiment, transmitter 208 is an ultrasonic transmitter 208 that emits or transmits ultrasonic waves or signals into recess 158. In such an embodiment, receiver 210 is an ultrasonic receiver 210 that receives or detects ultrasonic waves or signals, such as ultrasonic waves or signals transmitted by transmitter 208 and reflected or redirected by a container positioned within recess 158. In another embodiment, transmitter 208 is a microwave transmitter 208 or a radio transmitter 208 that emits or transmits microwave or radio waves or signals into recess 158. In such an embodiment, receiver 210 is a microwave receiver 210 or a radio receiver 210 that receives or detects microwave or radio waves or signals, such as microwave or radio waves or signals transmitted by transmitter 208 and reflected or redirected by a container positioned within recess 158. Alternatively, transmitter 208 and/or receiver 210 are any other transmitter, receiver, emitter, or sensor that enables detection device 176 to operate as described herein.

First and second sensor modules 202 and 204 detect a container and/or one or more characteristics of a container positioned within recess 158, and are in signal communication with controller 123 (shown in FIG. 1) to transmit a corresponding signal to controller 123. The detected characteristics of the container may include, for example, a presence, a position, a stability, a height, and/or a fill level of the container, a presence of at least one edge of the container or an opening defined within the container, and/or any other characteristic of the container. As used herein, the term "stability" or "stable" refers to a determination that a container is substantially stationary and/or a determination that a change in a position of a container over a predetermined amount of time is less than or equal to a predetermined threshold.

Figure 4:
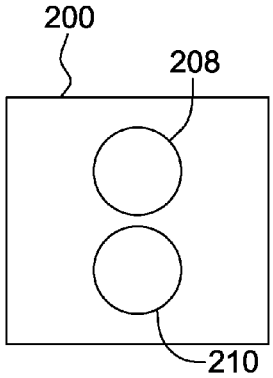

FIG. 4 is a block diagram of an exemplary sensor module 200, such as first sensor module 202 and/or second sensor module 204, suitable for use with dispensing system 160. In one embodiment, each sensor module 200 includes at least one transmitter 208 and at least one receiver 210 operatively coupled to controller 123.

In the exemplary embodiment, transmitter 208 is energized or activated to periodically emit an ultrasonic signal, and receiver 210 receives a corresponding reflected ultrasonic signal, as described in greater detail below. In a particular embodiment, transmitter 208 and/or receiver 210 include at least one acoustic transducer, such as for example, at least one membrane acoustical-electrical transducer. Alternatively, transmitter 208 and/or receiver 210 may be an antenna tuned to one or more microwave and/or radio frequencies to transmit and receive microwave or radio signals.

Figure 5:
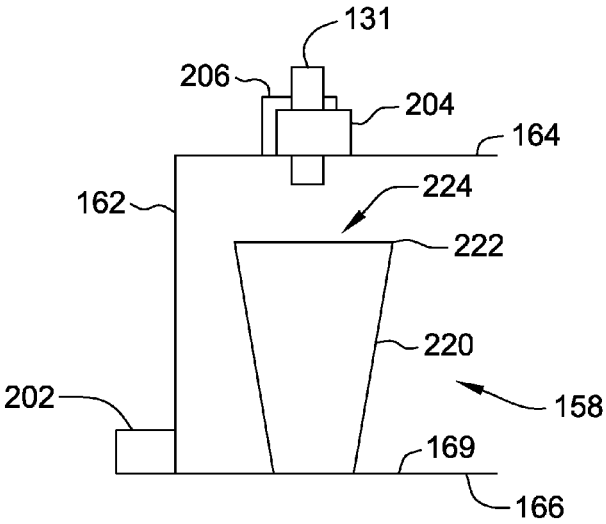

FIG. 5 is a block diagram of an exemplary dispensing system 160 including detection device 176. During an exemplary dispensing process, first sensor module 202 and/or second sensor module 204 periodically generates a sensor signal. In one embodiment, each transmitter 208 transmits sensor signals into recess 158 through outlets (not shown) defined within back wall 162 and top wall 164. When a container, such as a cup 220, is positioned adjacent or within recess 158, the sensor signals are reflected and/or redirected by cup 220. The reflected and/or redirected sensor signals are received or detected by receivers 210. Controller 123 is coupled in communication with sensor modules 200 and processes or analyzes the returned or reflected sensor signals detected or sensed by receivers 210 to determine geometric information and/or any other suitable characteristic of cup 220 based at least in part on data transmitted by sensor modules 200.

In the exemplary embodiment, first sensor module 202 detects a relative position of cup 220 with respect to recess 158. More specifically, first sensor module 202 detects a distance or a position of cup 220 with respect to back wall 162 of recess 158, generates a first signal representative of the distance or position of cup 220, and transmits the first signal to controller 123. In one embodiment, first sensor module 202 also detects a relative height of cup 220 with respect to support surface 169 of recess 158. More specifically, first sensor module 202 detects a relative height of cup 220 with respect to support surface 169 when a corresponding outlet is substantially covered or blocked. First sensor module 202 detects that a first outlet is covered when cup 220 substantially interferes with the sensor signal transmitted therefrom. In a particular embodiment, the first outlet is defined on or at least partially within back wall 162 and has a diameter of about 2.0 cm. Upon detecting the distance and the height, first sensor module 202 determines the presence of cup 220 within recess 158. In one embodiment, second sensor module 204 is activated and commences transmitting and receiving sensor signals when first sensor module 202 detects that cup 220 is positioned within recess 158.

In the exemplary embodiment, controller 123 determines the stability of cup 220 based on the first signal received. More specifically, controller 123 determines that cup 220 is stable, or substantially stationary, if the first signal is substantially constant such that the position of cup 220 does not change for a predetermined amount of time. Alternatively, controller 123 determines that cup 220 is stable by comparing the amount of change in the first signal over a predetermined amount of time to a predetermined threshold. If the amount of change in the first signal over the predetermined amount of time is equal to or less than the predetermined threshold, controller 123 determines that cup 220 is stable. If the amount of change in the first signal over the predetermined amount of time is greater than the predetermined threshold, controller 123 determines that cup 220 is not stable. Alternatively, controller 123 determines whether cup 220 is stable based on any other suitable calculation that enables dispensing system 160 to function as described herein.

During the exemplary dispensing process, second sensor module 204 detects a presence of at least one edge 222, such as at least one top edge 222, of cup 220 and/or a presence of an opening 224 defined within cup 220. More specifically, second sensor module 204 detects each edge 222 of cup 220 when each edge 222 interferes with, and reflects, the sensor signals transmitted by second sensor module 204. The presence of opening 224 may be detected or determined by receiving substantially no reflected sensor signals within an area bounded by edges 222 of cup 220. Alternatively, the presence of opening 224 may be detected by determining that sensor signals reflected within the area bounded by edges 222 are received at a later time than sensor signals reflected by edges 222. In the exemplary embodiment, second sensor module 204 generates a second signal representative of the presence of at least one edge 222 and/or the presence of opening 224 to controller 123. In one embodiment, the presence of at least one edge 222 is used to determine a height of cup 220.

In the exemplary embodiment, controller 123 determines whether cup 220 is aligned with dispenser 131 based on the first signal received. More specifically, controller 123 determines a position of dispenser 131 based on data stored in a memory device (not shown) and/or data programmed into controller 123. In the exemplary embodiment, controller 123 compares the position of dispenser 131 to the position of cup 220 to determine whether cup 220 is aligned with dispenser 131. Controller 123 enables a user to manipulate user interface 174 and activate dispenser 131 to dispense ice and/or liquid into cup 220 if controller 123 determines that cup 220 is positioned within recess 158, that cup 220 is stable, and that cup 220 is aligned with dispenser 131. For example, controller 123 may enable a button or an area of a touch screen (neither shown) within user interface 174 to be activated to enable the user to initiate the dispensing process. If controller 123 determines that cup 220 is not positioned within recess 158, that cup 220 is not stable, or that cup 220 is not aligned with dispenser 131, controller 123 deactivates dispenser 131 such that ice and/or liquid is not dispensed into cup 220.

During the exemplary dispensing process, second sensor module 204 also detects a fill level of ice and/or liquid within cup 220. Alternatively, third sensor module 206 or any other sensor detects the fill level within cup 220. In the exemplary embodiment, second sensor module 204 communicates with controller 123 to deactivate dispenser 131 upon detecting a fill level that approaches or reaches a selected or predetermined maximum fill level (i.e., upon detecting or determining that the fill level equals the maximum fill level or equals a predetermined level below the maximum fill level). In a particular embodiment, the maximum fill level is predetermined to be a level equal to about 90% of the height of cup 220 with respect to support surface 169 and/or a level equal to about 10% of the height of cup 220 below edge 222 of cup 220. In another embodiment, the maximum fill level is any other predetermined height or level, and/or a user sets the maximum fill level by manipulating user interface 174 to select one of a plurality of predefined maximum fill levels and/or to set any other maximum fill level. If the height of cup 220 is greater than the maximum fill level and if the detected fill level of ice and/or liquid within cup 220 is less than the maximum fill level, controller 123 activates dispenser 131 and maintains dispenser 131 in the activated state until the fill level reaches the maximum fill level. As such, liquid and/or ice is prevented from spilling from cup 220 during the dispensing process.

As described herein, controller 123 operates dispenser 131 in response to signals received from first sensor module 202 and/or second sensor module 204. When first sensor module 202 and second sensor module 204 communicate with controller 123 to activate dispenser 131, for example, by transmitting an appropriate signal to controller 123, controller 123 initiates or enables activation of dispenser 131. Controller 123 deactivates dispenser 131 when second sensor module 204 transmits an appropriate signal to controller 123 indicating that the liquid level and/or the ice level within cup 220 has reached, or is about to reach, the maximum fill level.

Controller 123 also deactivates dispenser 131 if second sensor module 204 detects that a fill level of ice and/or liquid does not increase within a first predetermined amount of time after dispenser 131 has been activated. In addition, controller 123 deactivates dispenser 131 if a second predetermined amount of time elapses after dispenser 131 has been activated and second sensor module 204 detects or determines that the fill level has not reached the maximum fill level.

Figure 6:
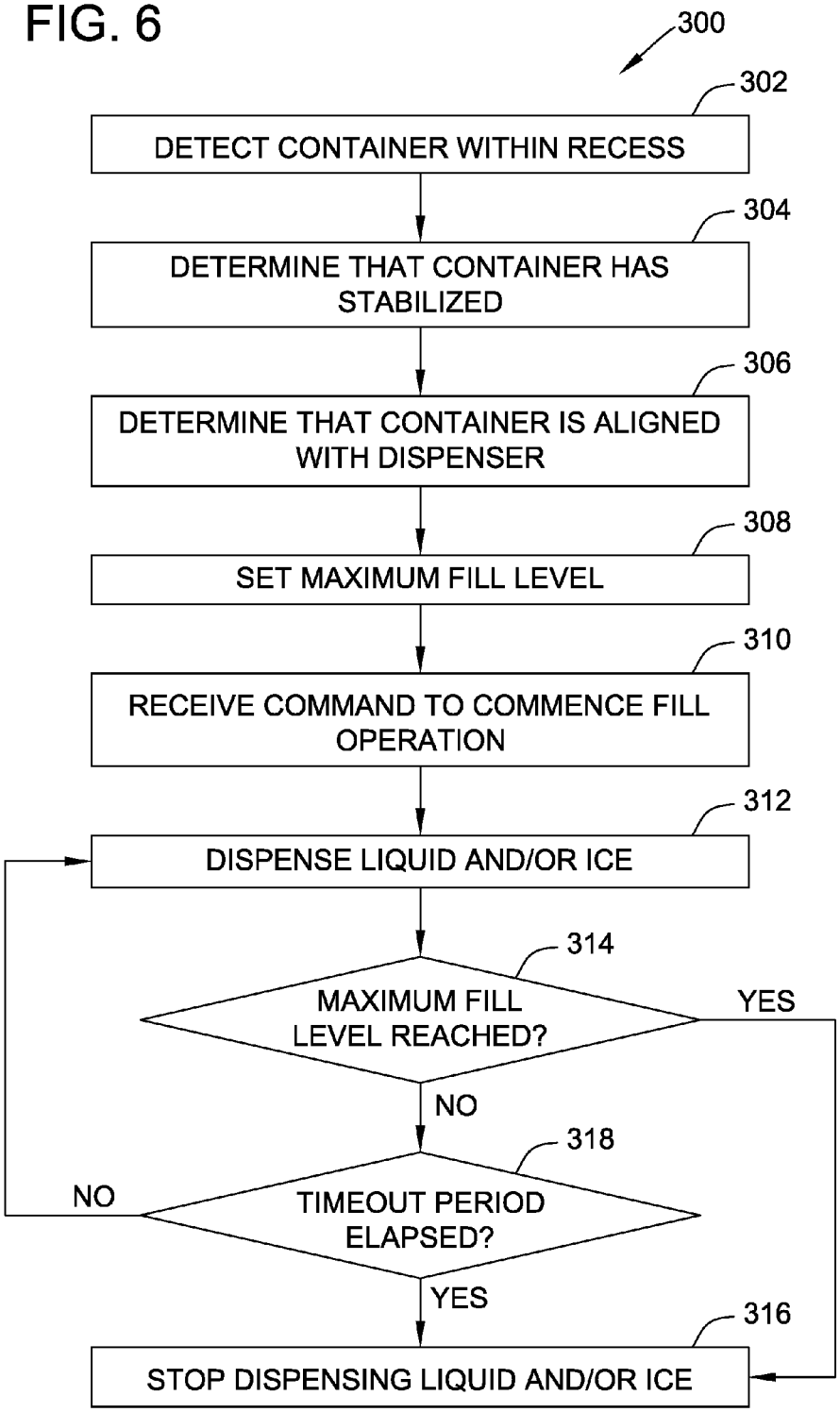

FIG. 6 is a flow diagram of an exemplary method 300 for dispensing a liquid and/or ice that may be used with dispensing system 160 (shown in FIG. 3) and refrigerator 100 (shown in FIG. 1). In the exemplary embodiment, method 300 is at least partially executed by controller 123 (shown in FIG. 1).

In the exemplary embodiment, a container, such as cup 220 (shown in FIG. 5) or another container, is detected 302 within recess 158 by first sensor module 202 (both shown in FIG. 3). Controller 123 determines 304 that the container has stabilized by monitoring and/or analyzing sensor signals received from first sensor module 202. In addition, controller 123 and/or second sensor module 204 (shown in FIG. 3) determines 306 that the container is aligned with dispenser 131 (shown in FIG. 2). A maximum fill level is set 308 for the container. In the exemplary embodiment, the maximum fill level is set 308 to be about 90% of a height of the container. Alternatively, the maximum fill level is set 308 by a user through user interface 174 (shown in FIG. 2) and/or is set 308 by controller 123 to be any other level that enables method 300 to function as described herein.

In the exemplary embodiment, a command to commence a fill operation is received 310 by controller 123. For example, controller 123 enables a button or another portion of user interface 174 to be activated, and the user operates user interface 174 to cause the fill operation to commence (i.e., to cause user interface 174 to transmit the command to controller 123). Controller 123 activates dispenser 131 (shown in FIG. 2) to dispense 312 liquid and/or ice into the container.

Controller 123 determines 314 whether the maximum fill level has been reached, for example, based on one or more sensor signals received from second sensor module 204. If the maximum fill level has been reached, controller 123 deactivates dispenser 131 to stop 316 dispensing liquid and/or ice. If the maximum fill level has not been reached, controller 123 determines 318 whether a predetermined timeout period has elapsed after commencing the dispensation 312 of liquid and/or ice. In the exemplary embodiment, the predetermined timeout period is a time period that is sufficient to fully dispense liquid and/or ice into a suitable container positioned within recess 158. As such, if the predetermined timeout period elapses without the maximum fill level being reached, a problem may exist with the container and/or dispensing system 160. Accordingly, if the predetermined timeout period has not elapsed, dispenser 131 continues dispensing 312 liquid and/or ice. However, if the predetermined timeout period is determined 316 to have elapsed, controller 123 deactivates dispenser 131 to stop 316 dispensing liquid and/or ice.

Figure 7:
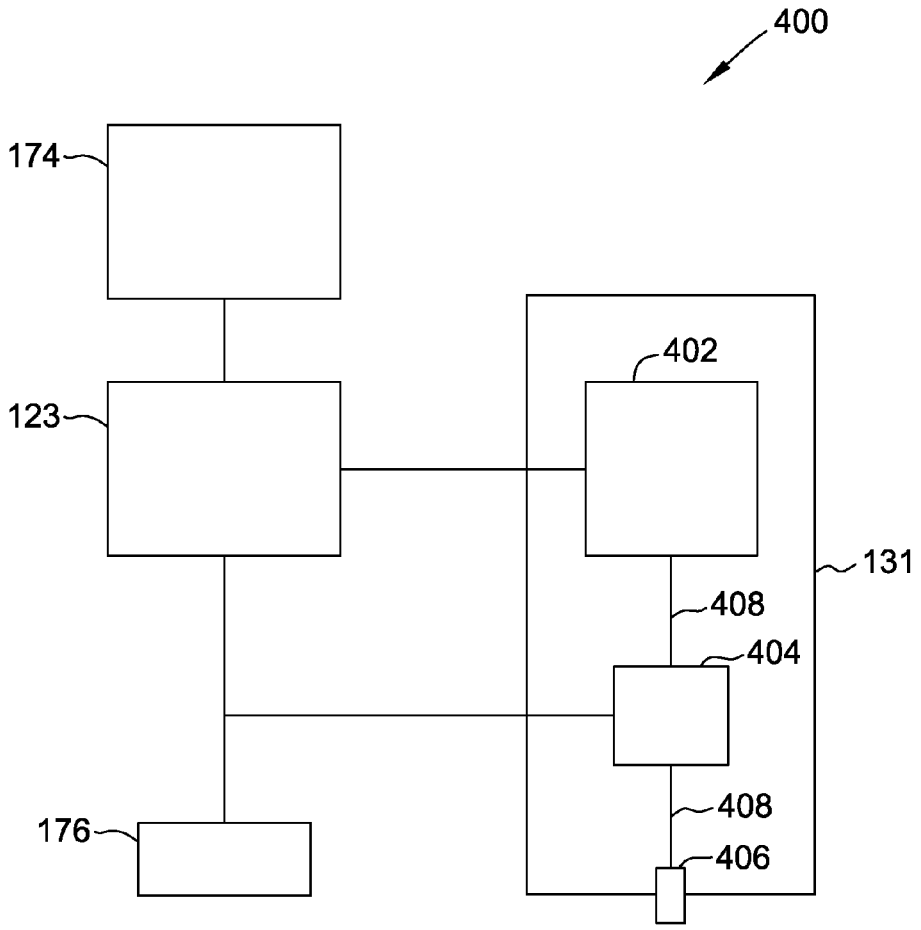

FIG. 7 is a block diagram of an exemplary dispensing system 400 that may be used with refrigerator 100 (shown in FIG. 1) to dispense ice and/or liquid, into a container, such as cup 220 (shown in FIG. 5). Unless otherwise specified, dispensing system 400 is similar to dispensing system 160 (shown in FIG. 3), and similar components are labeled in FIG. 7 with the same reference numerals used in FIG. 3.

In the exemplary embodiment, dispensing system 400 includes detection device 176, dispenser 131, controller 123, and user interface 174 that are each described above. Dispenser 131 includes a valve 402, a flow meter 404, and a dispenser outlet 406 coupled together by a conduit 408.

Valve 402, in the exemplary embodiment, is controlled by controller 123 to selectively enable or disable a flow of liquid from a liquid source (not shown) through conduit 408. The liquid is channeled through conduit 408 and is dispensed into cup 220 through dispenser outlet 406. Flow meter 404 measures a volume of liquid that flows through conduit 408 over a period of time and transmits signals representative of the volume measurements to controller 123.

During operation, a user manipulates user interface 174 to select a desired volume of liquid (hereinafter referred to as the "desired fill volume") to be dispensed into cup 220. User interface 174 communicates the desired fill volume to controller 123, and controller 123 operates valve 402 to enable liquid to flow through conduit 408. The liquid is dispensed through dispenser outlet 406 into cup 220. Controller 123 monitors the amount of liquid dispensed into cup 220 by accumulating the volume measurements received from flow meter 404. If controller 123 determines that the volume of liquid dispensed into cup 220 equals or exceeds the desired fill volume, controller 123 operates valve 402 to disable liquid from flowing through conduit 408 and from being dispensed through dispenser outlet 406.

In the exemplary embodiment, after the user selects the desired fill volume, detection device 176 is activated to enable controller 123 to detect whether an overfill condition of cup 220 occurs. As used herein, the term "overfill condition" refers to a situation in which cup 220 is filled above a predetermined maximum fill level and/or in which cup 220 is filled to a point of overflowing (i.e., to or above top edge 222 (shown in FIG. 5)). Such a condition may arise, for example, if the user erroneously selects a desired fill volume that exceeds a capacity of cup 220. In the exemplary embodiment, detection device 176 detects top edge 222 of cup 220 and detects a fill level of the liquid inside cup 220, as described above. If detection device 176 and/or controller 123 detects that the fill level has reached or exceeded top edge 222 (or has reached a predetermined level below top edge 222), detection device 176 and/or controller 123 determines that an overfill condition has occurred (i.e., cup 220 has been overfilled).

If controller 123 and/or detection device 176 determines that cup 220 has been overfilled, controller 123 operates valve 402 to disable liquid from flowing through conduit 408 and from being dispensed through dispenser outlet 406. Accordingly, dispensing system 400 dispenses a preselected volume of liquid into cup 220. If dispensing system 400 dispenses a volume of liquid into cup 220 that is greater than a capacity of cup 220 (e.g., if a user erroneously selects a desired fill volume that is greater than the capacity of cup 220), dispensing system 400 detects an overfill condition of cup 220 and stops dispensing the liquid into cup 220.

A technical effect of the system and method described herein includes at least one of: (a) detecting a container positioned within a recess defined within a housing; (b) determining a stability of a container positioned within a recess defined within a housing; and (c) activating a dispenser of a dispensing system in response to a detected container within a recess defined within a housing and in response to a determined stability of the container within the recess, wherein the dispenser is activated to dispense at least one of an amount of ice and an amount of a liquid into the container.

The above-described method and system for dispensing an amount of liquid, such as chilled water, and/or ice into a container positioned with respect to a dispenser facilitates accurately filling the container with liquid and/or ice to a desired fill level while preventing or limiting spills. More specifically, the dispensing system includes a detection device configured to detect a container positioned within a recess without contact between the detection device components and the container. The detection device is further configured to determine a stability of the container and to detect that the container is aligned with the dispenser. The detection device activates a dispenser to dispense an amount of chilled water and/or ice into the container when the stability of the container has been determined and when the container is determined to be aligned with the dispenser. The detection device is father configured to detect a fill level within the container and automatically deactivate the dispenser when the fill level reaches a predetermined maximum fill level. As a result, the touchless dispensing system accurately dispenses an amount of chilled water, or any suitable liquid, and/or ice into the container to a desired fill level without undesirable contact between the dispensing system components and the container, while preventing or limiting spills.

Exemplary embodiments of a method and system for dispensing an amount of liquid and/or ice into a container are described above in detail. The method and system are not limited to the specific embodiments described herein, but rather, steps of the method and/or components of the system may be utilized independently and separately from, or in combination with, other steps and/or components described herein. Further, the described method steps and/or system components can also be defined in, or used in combination with, other methods and/or systems, and are not limited to practice with only the method and system as described herein. Accordingly, any component and/or step described herein may be claimed in combination with any other component and/or step described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A dispensing system, comprising:

a dispenser configured to dispense at least one of ice and a liquid;

a detection device configured to:

detect a container positioned with respect to said dispenser;

generate a first signal representative of the container position; and a controller coupled to said detection device and to said dispenser, said controller configured to:

determine a stability of the container, wherein the stability is determined by a first determination that the container is substantially stationary and a second determination that a change in a position of the container over a predetermined amount of time is less than or equal to a predetermined threshold;

determine an alignment of the container with the dispenser; and activate said dispenser to dispense at least one of an amount of the ice and an amount of the liquid into the container based on the first signal, the determined alignment, and the determined stability of the container.

2. A dispensing system in accordance with claim 1, wherein said detection device comprises at least one sensor module configured to generate and receive at least one of ultrasonic signals, microwave signals, and radio signals.

3. A dispensing system in accordance with claim 2, wherein said at least one sensor module comprises a first sensor module configured to detect a relative position of the container with respect to said dispenser.

4. A dispensing system in accordance with claim 3, wherein said at least one sensor module further comprises a second sensor module configured to detect a presence of an opening defined within the container and generate a second signal representative of the presence of the opening.

5. A dispensing system in accordance with claim 4, wherein said second sensor module is configured to detect a fill level of at least one of ice and a liquid within the container and generate a third signal representative of the fill level.

6. A dispensing system in accordance with claim 5, wherein said controller is configured to activate said dispenser based on the first signal and the second signal, and to deactivate said dispenser based on the third signal.

7. A dispensing system in accordance with claim 5, further comprising a flow meter configured to measure an amount of liquid dispensed by said dispenser, wherein said controller is configured to determine if the amount of liquid dispensed equals a preselected fill volume.

8. A dispensing system in accordance with claim 7, wherein said controller is configured to determine whether an overfill condition of the container has occurred based on a signal received from said detection device.

9. A refrigeration appliance having a recess, said refrigeration appliance comprising:

a dispenser;

a detection device positioned with respect to the recess, said detection device configured to:

detect a container positioned within the recess;

generate a first signal representative of a position of the container within the recess; and a controller coupled to said detection device and to said dispenser, said controller configured to:

determine a stability of the container, wherein the stability is determined by a first determination that the container is substantially stationary and a second determination that a change in a position of the container over a predetermined amount of time is less than or equal to a predetermined threshold;

determine an alignment of the container with the dispenser; and activate said dispenser to dispense at least one of an amount of ice and an amount of liquid into the container based on the first signal, the determined alignment, and the determined stability of the container.

10. A refrigeration appliance in accordance with claim 9, wherein said detection device comprises a first sensor module configured to detect a relative position of the container with respect to said dispenser.

11. A refrigeration appliance in accordance with claim 10, wherein said detection device further comprises a second sensor module configured to detect a presence of an opening defined within the container and generate a second signal representative of the presence of the opening.

12. A refrigeration appliance in accordance with claim 11, wherein said second sensor module is configured to detect a fill level of at least one of ice and a liquid within the container and generate a third signal representative of the fill level.

13. A refrigeration appliance in accordance with claim 9, further comprising at least one refrigeration compartment, a first door defining the recess, and a second door movable between an open position and a closed position, wherein in the closed position said second door is configured to sealingly enclose said at least one refrigeration compartment, and said dispenser is operable when said second door is in the open position.

14. A method for dispensing at least one of ice and a liquid into a container, said method comprising:

detecting a container positioned within a recess defined within a housing;

determining a stability of the container, wherein determining a stability comprises:

determining the container is substantially stationary; and determining a change in a position of the container over a predetermined amount of time is less than or equal to a predetermined threshold;

determining an alignment of the container with the dispenser; and activating a dispenser of a dispensing system in response to the detected container, the determined alignment, and the determined stability of the container within the recess, wherein the dispenser is activated to dispense at least one of an amount of the ice and an amount of the liquid into the container.

15. A method in accordance with claim 14, further comprising detecting a presence of an opening defined within the container.

16. A method in accordance with claim 14, further comprising determining a position of the container.

17. A method in accordance with claim 14, further comprising deactivating the dispenser when at least one of an amount of ice and an amount of liquid within the container equals a maximum fill level.

18. A method in accordance with claim 14, further comprising deactivating the dispenser when a predetermined time period has elapsed.

* * * * *